US009346263B2

(12) United States Patent
Shimoda

(10) Patent No.: US 9,346,263 B2
(45) Date of Patent: May 24, 2016

(54) INKJET PRINTER

(71) Applicant: RISO KAGAKU CORPORATION, Tokyo (JP)

(72) Inventor: Asayo Shimoda, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/670,660

(22) Filed: Mar. 27, 2015

(65) Prior Publication Data

US 2015/0298455 A1 Oct. 22, 2015

(30) Foreign Application Priority Data

Apr. 16, 2014 (JP) ..... 2014-084518

(51) Int. Cl.
*B41J 2/045* (2006.01)
*B41J 2/14* (2006.01)

(52) U.S. Cl.
CPC ..... *B41J 2/04588* (2013.01); *B41J 2/04505* (2013.01); *B41J 2/04581* (2013.01); *B41J 2/14209* (2013.01)

(58) Field of Classification Search
CPC . B41J 2/04573; B41J 2/04588; B41J 2/04581
See application file for complete search history.

(56) References Cited

U.S. PATENT DOCUMENTS

2012/0062633 A1* 3/2012 Kusunoki ..... 347/11
2012/0249638 A1* 10/2012 Takano ..... B41J 2/0454 347/10

FOREIGN PATENT DOCUMENTS

JP 7-17039 1/1995
JP 07017039 A * 1/1995

* cited by examiner

*Primary Examiner* — Sarah Al Hashimi
(74) *Attorney, Agent, or Firm* — Greenblum & Bernstein, P.L.C.

(57) ABSTRACT

Upon driving a driver to perform an ejection drive of each of ink chambers subjected to the ejection drive, a controller drives the driver to supply a drive signal having a corrected waveform which increases an ejection amount and an ejection speed of ink compared with those of a normal waveform, when a correction condition is satisfied. The correction condition includes that at least one of the ink chambers arranged next to the ink chamber subjected to the ejection drive is not subjected to the ejection drive in an immediately preceding time slot, and that both the ink chambers arranged next to the ink chamber subjected to the ejection drive in a same group are subjected to the ejection drive.

6 Claims, 8 Drawing Sheets

INKJET PRINTER

CROSS REFERENCE TO RELATED APPLICATION

This application is based upon and claims the benefit of priority from the prior Japanese Patent Application No. 2014-084518, filed on Apr. 16, 2014, the entire contents of which are incorporated herein by reference.

BACKGROUND

1. Technical Field

The present invention relates to an inkjet printer which performs printing by ejecting ink from an inkjet head.

2. Related Art

An inkjet printer including a shear-mode inkjet head is described in Japanese Unexamined Patent Application Publication No. H7-17039.

The shear-mode inkjet head includes a plurality of ink chambers arranged next to one another in a row. Each ink chamber has a nozzle communicating therewith. The ink chambers are isolated from each other by partition walls, each partition wall including two piezoelectric members polarized in different directions. Electrodes are provided on surfaces of the partition walls. Drive signals applied to the electrodes cause the partition walls to deform. The deformations of the partition walls cause changes in the volumes and the pressures in the ink chambers, and cause ink in the ink chambers to be ejected from the nozzles.

SUMMARY

In the above-described shear-mode inkjet head, the state of pressure in an ink chamber is influenced by the deformations of the partition walls caused by the ejection drive of other ink chambers. Further, depending on an ejection pattern, the ejection amount and ejection speed of ink ejected from the ink chamber may decrease under the influence of the ejection drive of other ink chambers.

A decrease in the ejection speed of ink causes the misaligned landing of ink onto a sheet. Moreover, a decrease in the ejection amount of ink makes flying ink prone to be drifted by an air stream. Accordingly, a decrease in the ejection amount of ink also contributes to misaligned ink landing. Misaligned ink landing causes print quality degradation.

An object of the present invention is to provide an inkjet printer which can reduce print quality degradation.

An inkjet printer in accordance with some embodiments includes an inkjet head, a driver, and a controller. The inkjet head is configured to eject ink onto a sheet being conveyed. The inkjet head includes: a plurality of ink chambers isolated from each other by partition walls and arranged next to one another in a row; a plurality of nozzles communicating with the respective ink chambers and configured to eject the ink in the ink chambers; and a plurality of variable portions configured to selectively deform the partition walls in response to one of a drive signal having a normal waveform and a drive signal having a corrected waveform which increases an ejection amount and an ejection speed of the ink compared with an ejection amount and an ejection speed of the normal waveform, and to cause the ink to be ejected from the plurality of nozzles by changes in pressures in the ink chambers due to deformations of the partition walls. The driver is configured to perform an ejection drive of each of the ink chambers by selectively supplying the drive signal having the normal waveform and the drive signal having the corrected waveform to the plurality of variable portions. The controller is configured to divide the plurality of ink chambers into n+1 (n=1, 2, . . . ) groups each formed by taking ink chambers while skipping n ink chambers from among the plurality of ink chambers, and to drive the driver to perform the ejection drive of the ink chambers subjected to the ejection drive in units of the groups, and complete the ejection drive of the ink chambers subjected to the ejection drive in all the groups within one cycle including n+1 time slots corresponding to the respective groups. Upon driving the driver to perform the ejection drive of each of the ink chambers subjected to the ejection drive, the controller is configured to: drive the driver to supply the drive signal having the normal waveform when a correction condition is not satisfied; and drive the driver to supply the drive signal having the corrected waveform when the correction condition is satisfied. The correction condition includes: that at least one of the ink chambers arranged next to the ink chamber subjected to the ejection drive is not subjected to the ejection drive in an immediately preceding time slot; and that both the ink chambers arranged next to the ink chamber subjected to the ejection drive in a same group are subjected to the ejection drive.

In the above-described configuration, the misaligned landing of ink and print quality degradation can be reduced.

The inkjet printer may further include an adjuster configured to adjust a distance between an ejection surface of the inkjet head and the sheet to be printed with the ink ejected from the nozzles, the ejection surface including openings of the nozzles. The correction condition may further include that the distance between the ejection surface and the sheet is larger than a threshold value.

According to the above-described configuration, in an apparatus including an adjuster configured to adjust the distance between the ejection surface and the sheet, appropriate ink ejection drive according to the degree of influence of the distance between the ejection surface and the sheet on misaligned ink landing can be performed.

The inkjet printer may further include a sheet conveyer configured to convey the sheet being printed with the ink ejected from the nozzles while holding the sheet by air suction. The correction condition may further include that a landing position of the ink ejected by the ejection drive of the ink chamber subjected to the ejection drive is located within a correction target region in an outer peripheral portion of the sheet.

According to the above-described configuration, in an apparatus including an air-suction-type sheet conveyer, appropriate ink ejection drive according to the degree of influence of air suction on misaligned ink landing can be performed.

The inkjet printer may further include: a sheet conveyer configured to convey the sheet being printed with the ink ejected from the nozzles while holding the sheet by air suction; and an adjuster configured to adjust a distance between an ejection surface of the inkjet head and the sheet being conveyed by the sheet conveyer, the ejection surface including openings of the nozzles. The correction condition may further include: that the distance between the ejection surface and the sheet is larger than a threshold value; or that a landing position of the ink ejected by the ejection drive of the ink chamber subjected to the ejection drive is located within a correction target region in an outer peripheral portion of the sheet.

In the above-described configuration, for example, if the distance between the ejection surface and the sheet is larger than the threshold value, the controller drives the driver to perform the ejection drive of the ink chamber subjected to the ejection drive based on the drive signal having the corrected waveform even if the landing position of ink ejected by the ejection drive of the ink chamber subjected to the ejection drive is located outside the correction target region in the outer peripheral portion of the sheet. Thus, an apparatus including an air-suction-type sheet conveyer and an adjuster configured to adjust the distance between the ejection surface and the sheet, misaligned ink landing and print quality degradation can be reduced by ink ejection drive according to the degree of influence of air suction and the distance between the ejection surface and the sheet on misaligned ink landing.

The controller may be configured to adjust the corrected waveform according to a temperature of the ink.

In the above-described configuration, since the corrected waveform is adjusted according to the temperature of ink, misaligned ink landing and print quality degradation can be further reduced.

DETAILED DESCRIPTION

Figure 1:
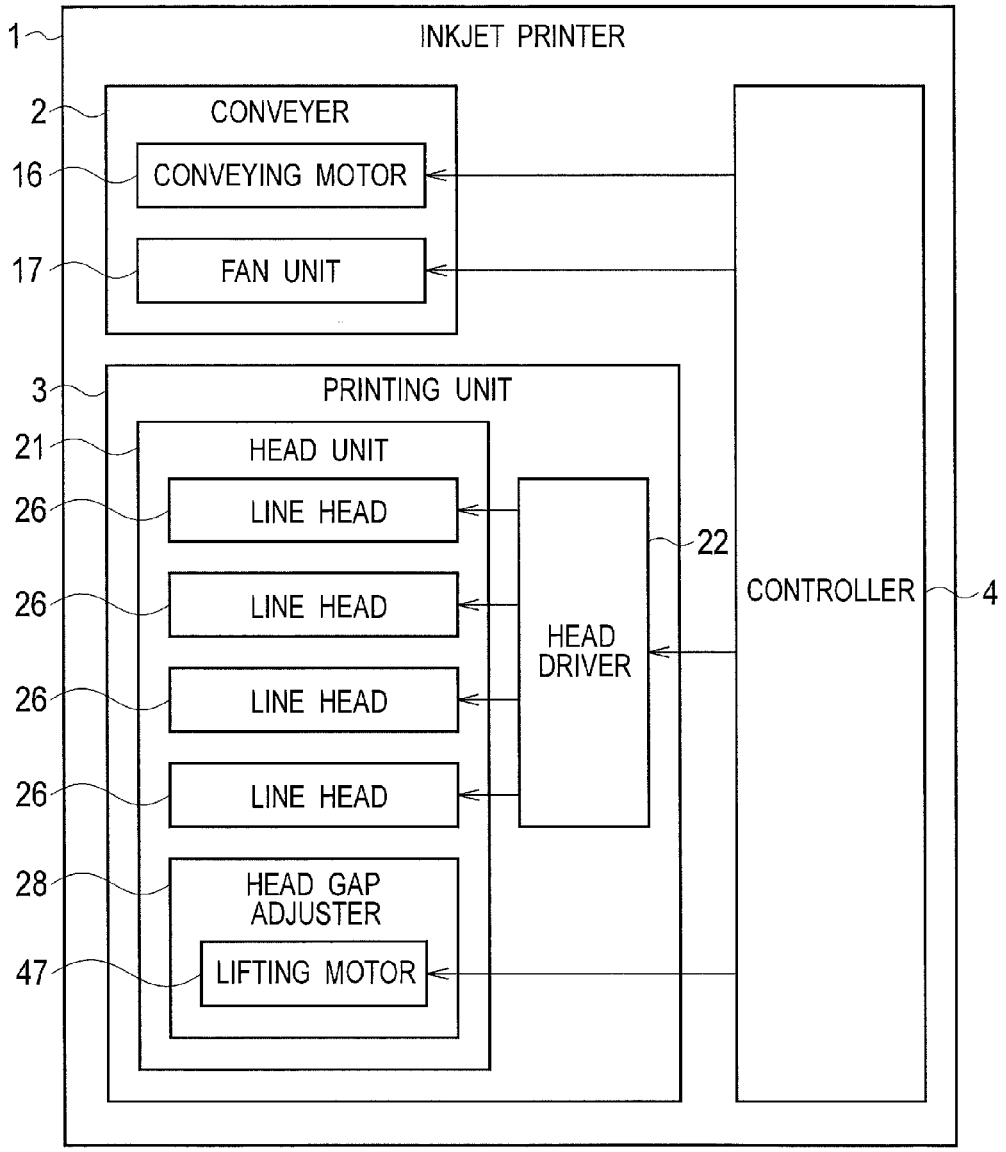
FIG. 1 is a block diagram showing the configuration of an inkjet printer according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
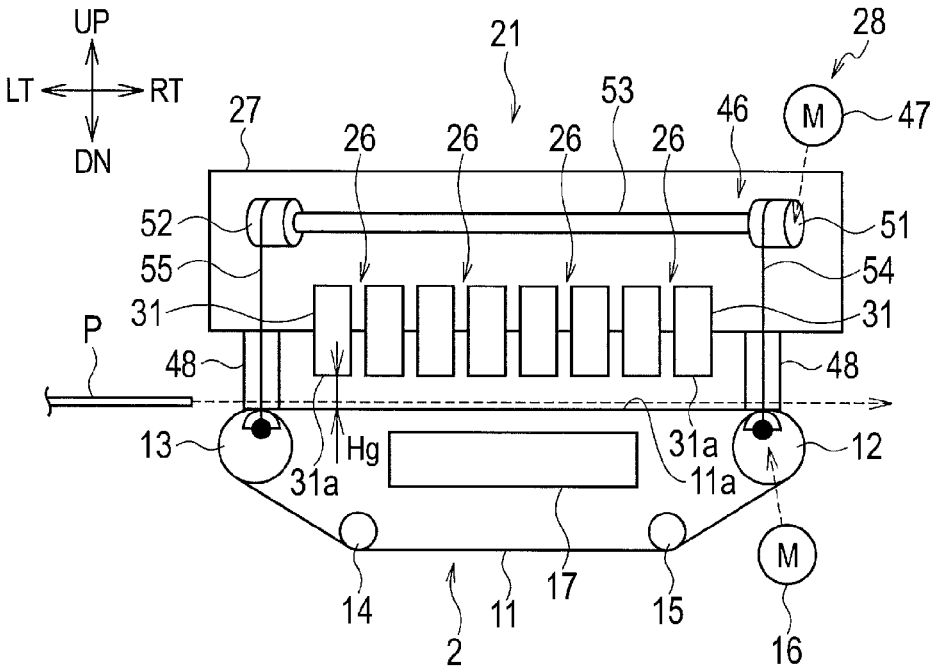
FIG. 2 is a schematic configuration diagram showing a conveyer and a head unit.
Figure 3:
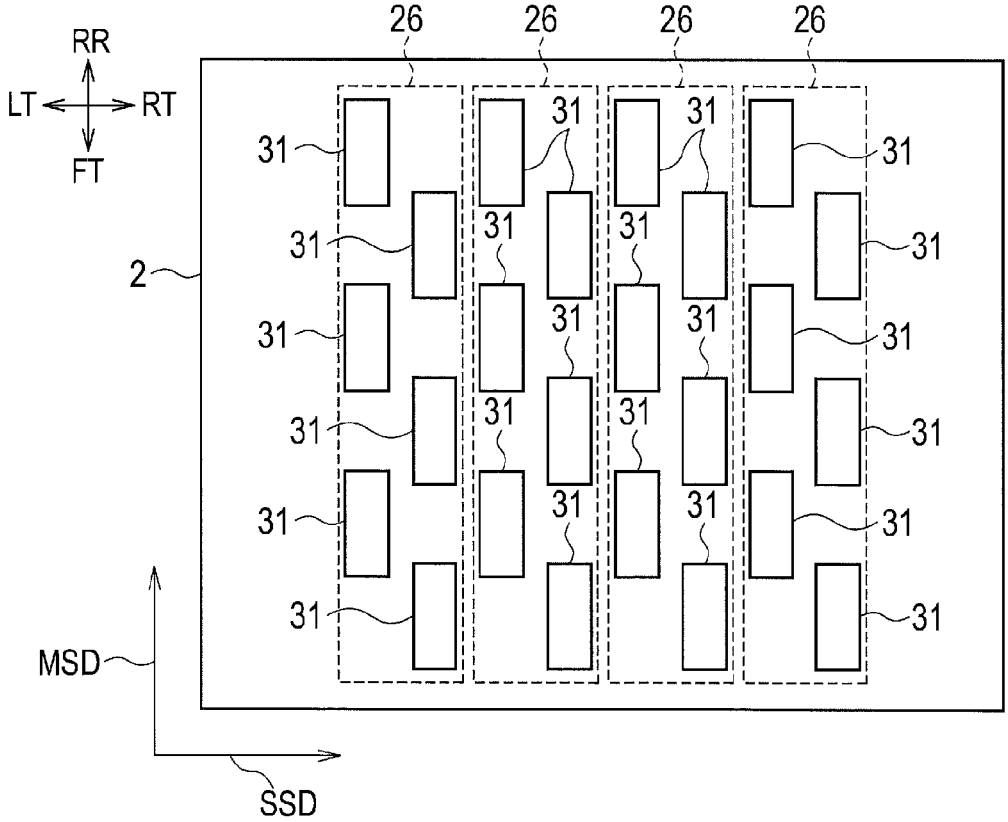
FIG. 3 is a diagram for explaining the arrangement of inkjet heads.
Figure 4:
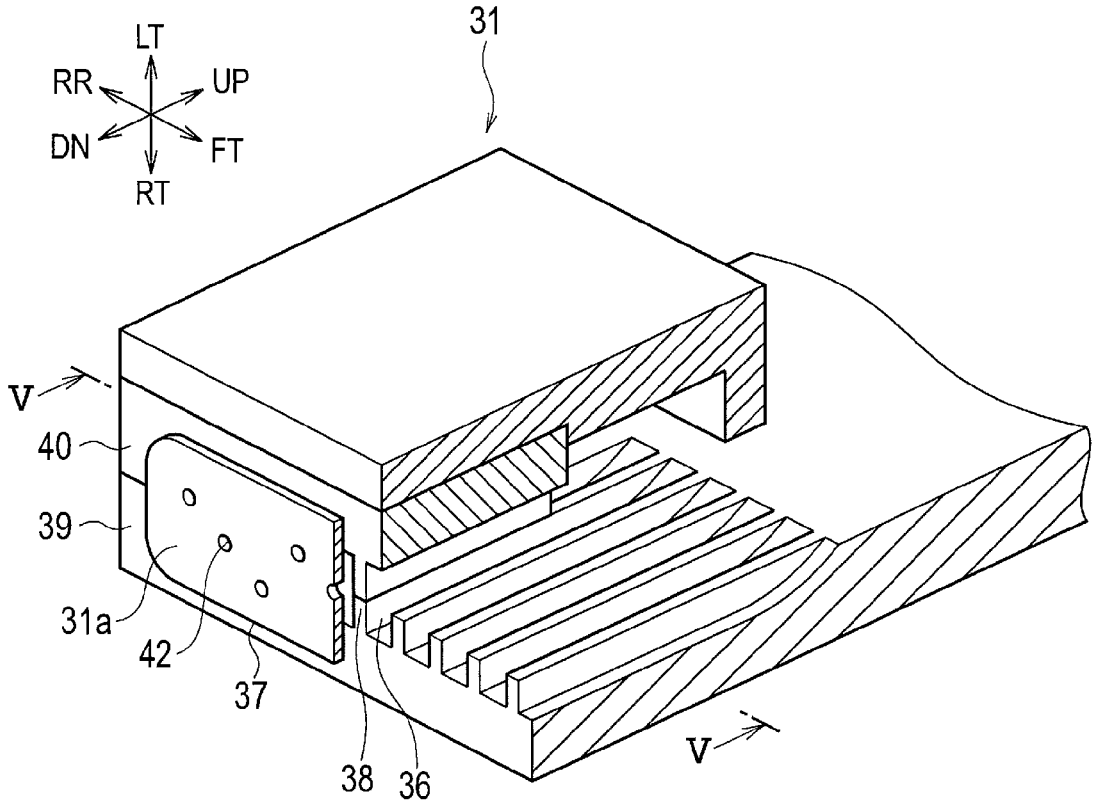
FIG. 4 is a partially cross-sectional perspective view showing a schematic configuration of an inkjet head.
Figure 5:
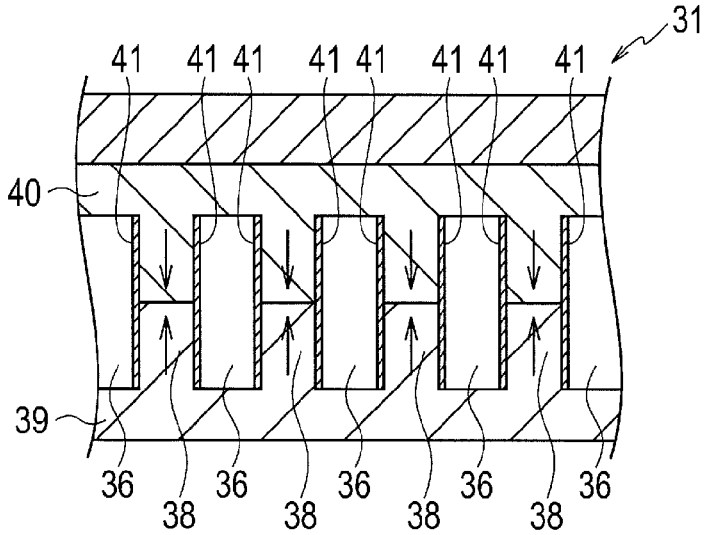
FIG. 5 is a partial cross-sectional view of the inkjet head taken along line V-V in FIG. 4.

FIG. 1 is a block diagram showing the configuration of an inkjet printer according to an embodiment of the present invention. FIG. 2 is a schematic configuration diagram showing a conveyer and a head unit of the inkjet printer shown in FIG. 1. FIG. 3 is a diagram for explaining the arrangement of inkjet heads. FIG. 4 is a partially cross-sectional perspective view showing a schematic configuration of an inkjet head. FIG. 5 is a partial cross-sectional view of the inkjet head taken along line V-V in FIG. 4.

In the following description, the direction perpendicular to the plane of FIG. 2 is regarded as the front-back direction, and the direction pointing out of the plane of FIG. 2 is regarded as forward. Moreover, in FIG. 2, up, down, left, and right in the drawing are regarded as up, down, left, and right. Moreover, in FIG. 2, the left-to-right direction is the direction of conveyance of a sheet P as a print medium. In the following description, the words upstream and downstream mean upstream and downstream with respect to the direction of conveyance of the sheet P. In the drawings, right, left, up, down, front, and rear are denoted by RT, LT, UP, DN, FT, and RR, respectively. Moreover, in the drawings, the direction of conveyance of the sheet P (subscanning direction) and the front-back direction (main scanning direction) are denoted by SSD and MSD, respectively.

As shown in FIG. 1, an inkjet printer 1 according to the present embodiment includes a conveyer (sheet conveyer) 2, a printing unit 3, and a controller 4.

The conveyer 2 conveys the sheet P while holding the sheet P by air suction. As shown in FIGS. 1 and 2, the conveyer 2 includes a conveyer belt 11, a drive roller 12, driven rollers 13, 14, and 15, a conveying motor 16, and a fan unit 17.

The conveyer belt 11 conveys the sheet P while holding the sheet P by suction. The conveyer belt 11 is a looped belt passed over the drive roller 12 and the driven rollers 13 to 15. Multiple belt holes, which are through holes for holding the sheet P by suction, are formed over the entire area of the conveyer belt 11. The conveyer belt 11 holds the sheet P on a conveying surface (upper surface) 11*a* by a suction force generated in the belt holes by the air suction of the fan unit 11. The conveyer belt 11 rotates in the clockwise direction in FIG. 1 to convey the sheet P held by suction to the right.

The drive roller 12 rotates the conveyer belt 11.

The driven rollers 13 to 15 are driven by the drive roller 12 via the conveyer belt 11. The driven roller 13 is disposed to the left of the drive roller 12 at the same height as the drive roller 12. The driven rollers 14 and 15 are disposed at the same height below the drive roller 12 and the driven roller 13 to be separated from each other in the right-left direction.

The conveying motor 16 rotates the drive roller 12.

The fan unit 17 produces downward air streams. In this way, the fan unit 17 draws out air through the belt holes of the conveyer belt 11 to create negative pressures in the belt holes, thus attaching the sheet P onto the conveyer belt 11 by suction. The fan unit 17 includes a plurality of fans (not shown). The fan unit 17 is disposed between the drive roller 12 and the driven roller 13.

The printing unit 3 performs printing on the sheet P which is being conveyed by the conveyer 2. The printing unit 3 includes a head unit 21 and a head driver (driver) 22.

The head unit 21 ejects ink onto the sheet P to print an image thereon. The head unit 21 includes four line heads 26, a head holder 27, and a head gap adjuster (adjuster) 28.

The four line heads 26 eject ink of different colors. For example, the four line heads 26 eject ink of cyan (C), black (K), magenta (M), and yellow (Y), respectively. The four line heads 26 are disposed side by side in the right-left direction above the conveyer 2. As shown in FIG. 3, each of the line heads 26 includes six inkjet heads 31. It should be noted that in FIG. 3, the head holder 27 and the like are not shown.

The inkjet head 31 has a plurality of nozzles 42 (see FIG. 4) having openings in an ejection surface (lower surface) 31*a* which faces a conveying surface 11*a* of the conveyer belt 11, and ejects ink from the nozzles 42. In each of the line heads 26, the six inkjet heads 31 are staggered along the front-back direction. Specifically, the six inkjet heads 31 are arranged along the front-back direction and disposed to be alternately shifted in the right-left direction. The inkjet head 31 can change the number (drop number) of ink droplets to be ejected from one nozzle 42 to one pixel, and performs printing in which shades of color are produced by changing the drop number.

The inkjet head 31 is of a shear-mode type. As shown in FIGS. 4 and 5, the inkjet head 31 has a plurality of ink chambers 36 and a nozzle plate 37.

The ink chambers 36 hold ink supplied thereto and cause ink to be ejected from the nozzles 42 of the nozzle plate 31, which will be described later. The ink chambers 36 are arranged next to one another in a row in the main scanning direction (front-back direction). Partition walls 38 which isolate the ink chambers 36 from each other are formed by a first piezoelectric member 39 and a second piezoelectric member 40. The first piezoelectric member 39 and the second piezoelectric member 40 are made of a publicly-known piezoelectric material such as PZT ($PbZrO_3$—$PbTiO_3$). The first piezoelectric member 39 and the second piezoelectric member 40 are polarized in different directions as indicated by arrows in FIG. 5.

Electrodes 41 (variable portions) are formed on surfaces of the partition walls 38 constituting side surfaces of the ink chambers 36 to be closely attached thereto. The electrodes 41 cause shear strains in the partition walls 38 according to drive signals to change the volumes of the ink chambers 36 and the pressures in the ink chambers 36. This causes the ink in the ink chambers 36 to be ejected from the nozzles 42.

The nozzle plate 37 is a plate-shaped member in which the nozzles 42 communicating with the respective ink chambers 36 are formed. The nozzle plate 37 is disposed at a lower ends of the ink chambers 36. A surface (lower surface) of the nozzle plate 37 constitutes the ejection surface 31*a* of the inkjet head 31.

The nozzles 42 are equally spaced in the main scanning direction (front-back direction). Moreover, the nozzles 42 are shifted in the subscanning direction (right-left direction) in units of groups in time-division drive control, which will be described later.

The head holder 27 holds the inkjet heads 31. The head holder 27 is formed in the shape of a hollow, approximate cuboid. The head holder 27 is disposed above the conveyer 2. The head holder 27 holds the inkjet heads 31 in a state in which lower end portions of the inkjet heads 31 are protruded downward from a bottom surface thereof.

The head gap adjuster 28 adjusts a head gap Hg. The head gap Hg is the distance between the conveying surface 11*a* of the conveyer belt 11 and the ejection surfaces 31*a* of the inkjet heads 31. The head gap Hg is adjusted according to the type of the sheet P (thickness of the sheet P) to be used in printing. The head gap adjuster 28 includes a lifting mechanism 46, a lifting motor 47, and end members 48.

The lifting mechanism 46 is intended to raise or lower the conveyer 2 toward or away from the inkjet heads 31. There are two lifting mechanisms 46 separated from each other in the front-back direction. The lifting mechanism 46 includes a pair of pulleys 51 and 52, a shaft 53, and wires 54 and 55.

The pulleys 51 and 52 are configured to wind and retrieve the wires 54 and 55, respectively. The pulleys 51 and 52 are disposed at a left end portion and a right end portion in the head holder 27, respectively.

The shaft 53 is a rotating shaft for the pair of pulleys 51 and 52. The shaft 53 is formed by a long member extending in the right-left direction. The pulley 51 is fixed to one end of the shaft 53, and the pulley 52 is fixed to other end thereof.

The wires 54 and 55 hold the conveyer 2 in a suspending manner. One ends of the wires 54 and 55 are connected to the conveyer 2, and other ends thereof are wound around the pulleys 51 and 52. The winding or retrieving of the wires 54 and 55 by the rotation of the pulleys 51 and 52 raise or lower the conveyer 2.

The lifting motor 47 rotates the shaft 53 and thereby rotates the pulleys 51 and 52.

The end members 48 are members for adjusting the head gap Hg. The end members 48 are installed upright on corner portions of a bottom surface of the head holder 27. The conveyer 2 is touched to lower ends of the end members 48 to be positioned. The end member 48 is configured such that a vertical length thereof can be adjusted in a plurality of steps according to the head gap Hg to be set.

The head driver 22 drives the inkjet heads 31 to cause the inkjet heads 31 to eject ink. Specifically, the head driver 22 supplies drive signals to the electrodes 41 to deform the partition walls 38, and performs the ejection drive of the ink chambers 36 so that changes in the pressures in the ink chambers 36 caused by the deformations of the partition walls 38 may cause ink to be ejected from the nozzles 42.

The controller 4 controls the operation of each section of the inkjet printer 1. The controller 4 includes a CPU and a storage such as a RAM, a ROM, and a hard disk. The controller 4 executes a required program stored in the storage to be used in the present apparatus, thereby implementing the following control (functions).

Specifically, the controller 4 performs control so that printing may be performed on the sheet P by causing the inkjet heads 31 of the printing unit 3 to eject ink while the conveyer 2 is conveying the sheet P. At this time, the controller 4 causes the inkjet heads 31 to be driven by time-division drive control, which will be described later.

At the time of the ejection drive of the ink chamber 36 subjected to the ejection drive (i.e. the ink chamber 36 as an ejection drive target), if the ink chamber 36 subjected to the ejection drive satisfies undermentioned correction conditions (correction conditions 1 to 3) in undermentioned patterns, the controller 4 controls the head driver 22 so that the head driver 22 may perform the ejection drive of the ink chamber 36 subjected to the ejection drive using a drive signal having a corrected waveform that increases the ejection amount and ejection speed of ink compared with those of a normal waveform for use in the case where the correction conditions are not satisfied. The normal waveform and the corrected waveform will be described later.

Specifically, correction condition 2 is that "a head-to-sheet distance Hp is larger than a threshold value Hth at the time of the ejection drive of the ink chamber 36 subjected to the ejection drive" (Hth<Hp). Correction condition 3 is that "the landing position of ink ejected by the ejection drive of the ink chamber 36 subjected to the ejection drive is located within a correction target region R in an outer peripheral portion of the sheet P at the time of the ejection drive of the ink chamber 36 subjected to the ejection drive." Correction condition 1 will be described later.

For example, if the head-to-sheet distance Hp is not more than the threshold value Hth (i.e., if correction condition 2 is not satisfied), and if the landing position of ink ejected by the ejection drive of the ink chamber 36 subjected to the ejection drive is located outside the correction target region R in the outer peripheral portion of the sheet P (i.e., if correction condition 3 is not satisfied), the controller 4 controls the head driver 22 so that the head driver 22 may perform the ejection drive of the ink chamber 36 subjected to the ejection drive based on the drive signal having the normal waveform even if the undermentioned correction condition 1 is satisfied.

If correction condition 1 is satisfied and if any one of correction condition 2 and correction condition 3 is satisfied, the controller 4 controls the head driver 22 so that the head driver 22 may perform the ejection drive of the ink chamber 36 subjected to the ejection drive based on the drive signal having the corrected waveform. Specifically, if the correction condition 1 is satisfied and if the landing position of ink ejected by the ejection drive of the ink chamber 36 subjected to the ejection drive is located within the correction target region R (i.e., if correction condition 3 is satisfied), the controller 4 controls the head driver 22 so that the head driver 22 may perform the ejection drive of the ink chamber 36 subjected to the ejection drive based on the drive signal having the corrected waveform even if the head-to-sheet distance Hp is not more than the threshold value Hth (i.e., if correction condition 2 is not satisfied). Moreover, if correction condition 1 is satisfied and if the head-to-sheet distance Hp is larger than the threshold value Hth (i.e., if correction condition 2 is satisfied), the controller 4 controls the head driver 22 so that the head driver 22 may perform the ejection drive of the ink chamber 36 subjected to the ejection drive based on the drive signal having the corrected waveform regardless of the landing position of ink ejected by the ejection drive of the ink chamber 36 subjected to the ejection drive (even if the landing position is located outside the correction target region R) (i.e., regardless of whether correction condition 3 is satisfied or not).

The head-to-sheet distance Hp is the distance between the ejection surface 31*a* and the sheet P. In other words, the head-to-sheet distance Hp is a distance obtained by subtracting the thickness of the sheet P from the head gap Hg. As described previously, the head gap Hg is adjusted according to the sheet type (thickness of the sheet P). The head gap Hg can be adjusted in a plurality of steps by adjusting the lengths of the end members 48, but individual values cannot necessarily be set for all sheet types. Accordingly, for example, there are cases where the same value of the head gap Hg is assigned to sheet types having thicknesses close to each other. Therefore, the head-to-sheet distance Hp varies according to the sheet type. The controller 4 stores a head-to-sheet distance Hp corresponding to each sheet type in advance.

The threshold value Hth is a threshold value for determining whether or not the head-to-sheet distance Hp is a distance at which misaligned ink landing occurs. Ink flying after being ejected from the nozzle 42 is affected by air streams such as conveying air streams caused by the movement of the conveyer belt 11 and the sheet P and undermentioned air streams W shown in FIG. 6. As the head-to-sheet distance Hp increases, the distance for which the ink is drifted by air streams increases. Accordingly, as the head-to-sheet distance Hp increases, the possibility of misaligned ink landing increases.

Figure 6:
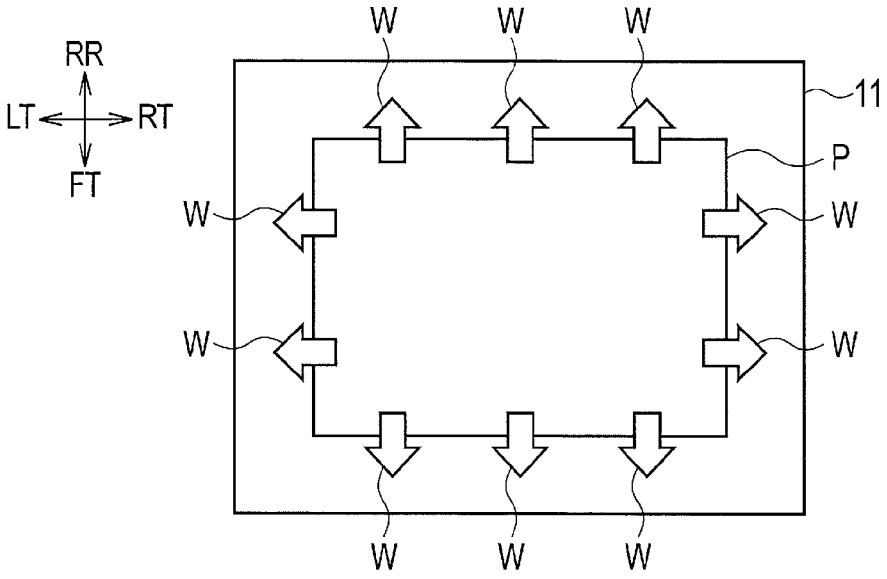
FIG. 6 is a diagram for explaining air streams generated by air suction in the conveyer.
Figure 7:
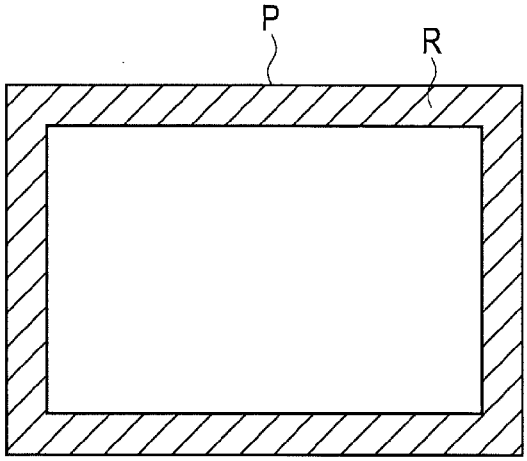
FIG. 7 is a diagram showing a correction target region.

The correction target region R is a region set as a region in which misaligned landing of ink is likely to occur under the influence of air suction in the conveyer 2. When the sheet P is conveyed by the conveyer 2, airstreams W flowing toward the outside of the sheet P are generated in the outer peripheral portion of the sheet P as shown in FIG. 6. The air streams W are air streams generated by the fan unit 17 drawing out air through the belt holes of the conveyer belt 11. In the outer peripheral portion of the sheet P, misaligned ink landing is likely to occur under the influence of the air streams W. Accordingly, the correction target region R is set in the outer peripheral portion of the sheet P as shown in FIG. 7. The correction target region R is set according to the sheet size, the sheet type, the orientation of the sheet P at the time of conveyance, and the like in advance.

Next, a basic ejecting operation of the inkjet head 31 will be described.

Figure 8:
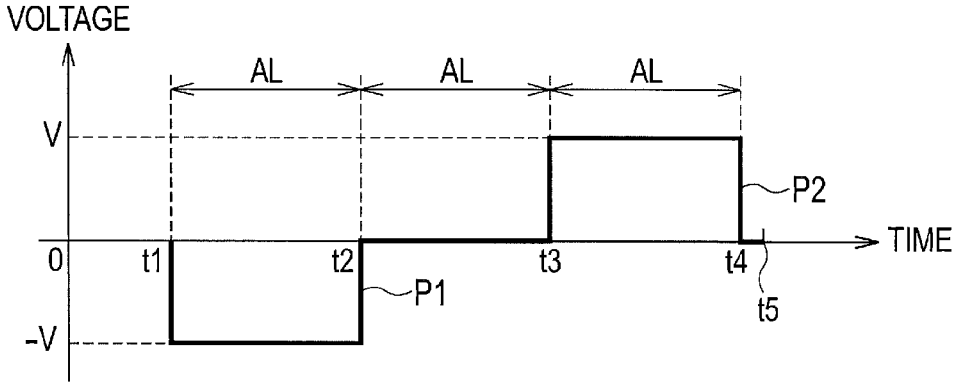
FIG. 8 is a diagram showing a waveform of a drive signal for ejecting a drop of ink.
Figure 9:
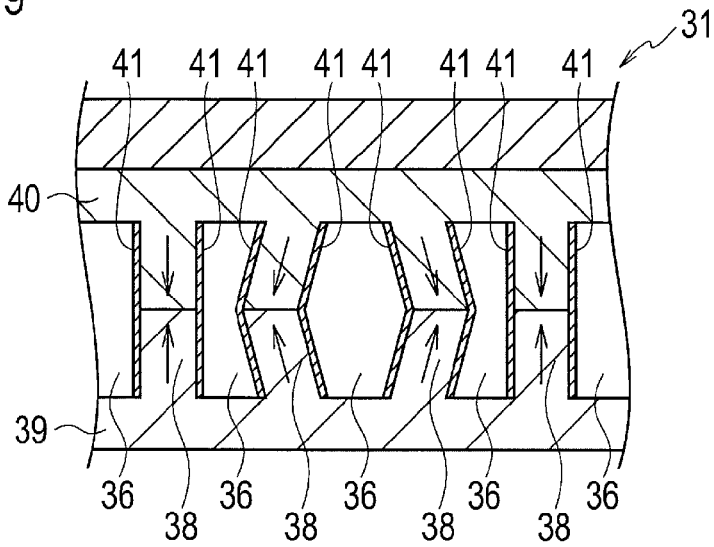
FIG. 9 is an operation diagram for explaining an ejecting operation of the inkjet head.
Figure 10:
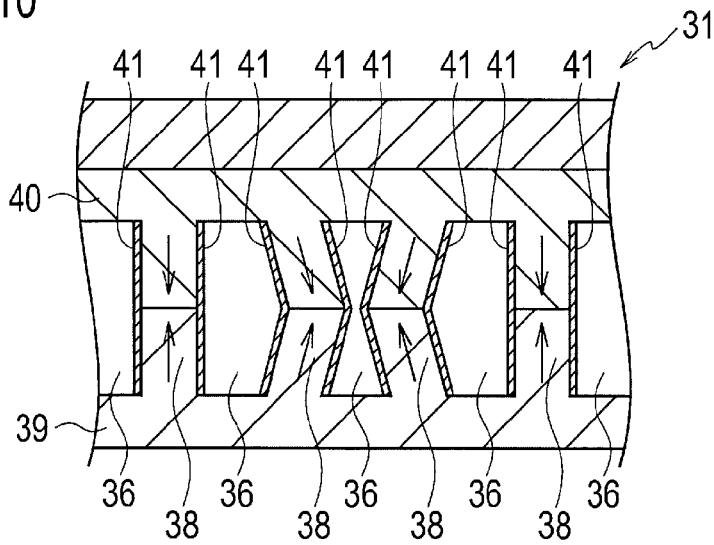
FIG. 10 is an operation diagram for explaining an ejecting operation of the inkjet head.

FIG. 8 is a diagram showing a waveform of a drive signal for ejecting a drop of ink. FIGS. 9 and 10 are operation diagrams for explaining an ejecting operation of the inkjet head 31.

The following description will be made for the case where the central ink chamber 36 in FIG. 5 performs an ejecting operation. From a steady state shown in FIG. 5, at time t1 in FIG. 8, the electrodes 41 of the ink chambers 36 arranged next to (i.e. adjacent on both sides of) the central ink chamber 36 subjected to the ejection drive are grounded, and an expanding pulse P1 of a negative voltage (−V) is applied to the electrodes 41 of the central ink chamber 36.

Then, an electric field is generated which is perpendicular to the directions of polarization of the first piezoelectric member 39 and the second piezoelectric member 40 constituting the partition walls 38 on the two opposite sides of the central ink chamber 36. This causes shear deformations at the junctions between the first piezoelectric member 39 and the second piezoelectric member 40. As shown in FIG. 9, the partition walls 38 on the two opposite sides of the central ink chamber 36 deform away from each other, and the volume of the central ink chamber 36 is expanded. As a result, a negative pressure is generated in the central ink chamber 36, and ink flows into the central ink chamber 36.

The pulse length (applying time) of the expanding pulse P1 is one AL. The AL (Acoustic Length) is the time taken by a pressure wave generated by ink flowing into the ink chamber 36 with an expanded volume to propagate throughout the ink chamber 36 and reach the nozzle 42. The AL is determined depending on the structure of the inkjet head 31, the density of ink, and the like.

From the state of FIG. 9, at time t2 in FIG. 8, the voltage applied to the electrodes 41 of the central ink chamber 36 is returned to the ground voltage. Thus, the partition walls 38 on the two opposite sides of the central ink chamber 36 return from the state of FIG. 9 to a neutral position shown in FIG. 5. As a result, ink in the central ink chamber 36 is rapidly pressurized, and ink is ejected from the corresponding nozzle 42.

When a pause time of one AL has elapsed since the voltage applied to the electrodes 41 of the central ink chamber 36 has been returned to the ground potential, a contracting pulse P2 of a positive voltage (V) is applied to the electrodes 41 of the central ink chamber 36 for a period of time of one AL from time t3 to time t4. As shown in FIG. 10, the application of the contracting pulse P2 causes the partition walls 38 on the two opposite sides of the central ink chamber 36 to deform toward each other, and the volume of the central ink chamber 36 is contracted.

Ink is ejected by the pressure in the ink chamber 36 reaching a peak immediately after the application of the expanding pulse P1 is finished. After the pressure reaches the peak, a negative pressure is generated in the ink chamber 36. By applying the contracting pulse P2 to contract the volume of the ink chamber 36 and generate a pressurizing force, the negative pressure in the ink chamber 36 after ink ejection is decreased, and the residual vibration of ink in the ink chamber 36 is attenuated. Thus, a next ejecting operation can be stably performed.

After the application of the contracting pulse P2, the voltage applied to the electrodes 41 of the central ink chamber 36 is set to the ground potential during a period of time from time t4 to time t5, and the state of FIG. 5 is restored. Thus, a single (one drop) ejecting operation is ended.

Next, the time-division drive control of the inkjet head 31 will be described.

In the shear-mode inkjet head 31, since ink is ejected by utilizing the deformations of the partition walls 38 as described above, adjacent ink chambers 36 cannot be simultaneously driven for ejection. Accordingly, the controller 4 divides all the ink chambers 36 included in the inkjet head 31 into a plurality of groups each including ink chambers 36 which are not arranged next to each other, and performs the ejection drive of the ink chambers 36 in units of the groups.

Specifically, in the inkjet printer 1, the controller 4 divides the ink chambers 36 of the inkjet head 31 into n+1 (n=1, 2, . . . ) groups each formed by taking ink chambers 36 while skipping n ink chambers 36 from among the ink chambers 36. Further, the controller 4 controls the head driver 22 so that the ejection drive of the ink chambers subjected to the ejection drive of all the groups is performed in one cycle including n+1 time slots corresponding to the respective groups.

In the present embodiment, it is assumed that the controller 4 divides the ink chambers 36 into three groups such that ink chambers 36 separated at intervals of two ink chambers 36 are placed into the same group. In this case, the ink chambers 36 of the inkjet head 31 are divided into three groups shown in FIG. 11: group A including the ink chambers 36A1, 36A2, and 36A3; group B including the ink chambers 36B1, 36B2, and 36B3; and group C including the ink chambers 36C1, 36C2, and 36C3.

Figure 11:
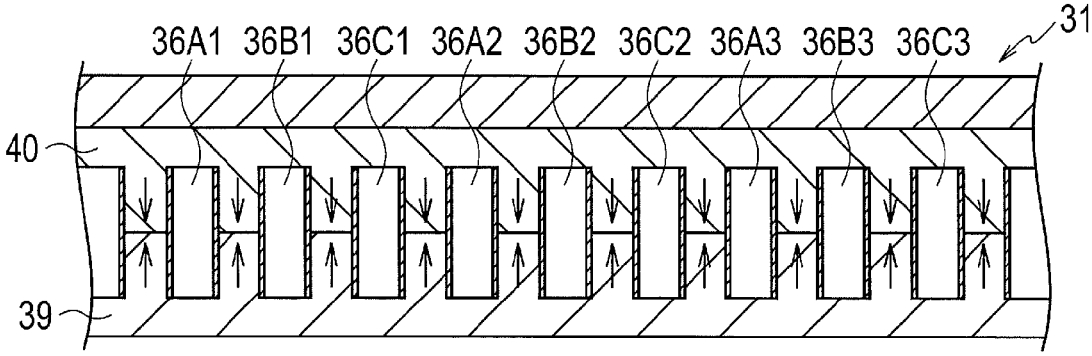
FIG. 11 is a diagram for explaining groups in time-division drive control.
Figure 12:
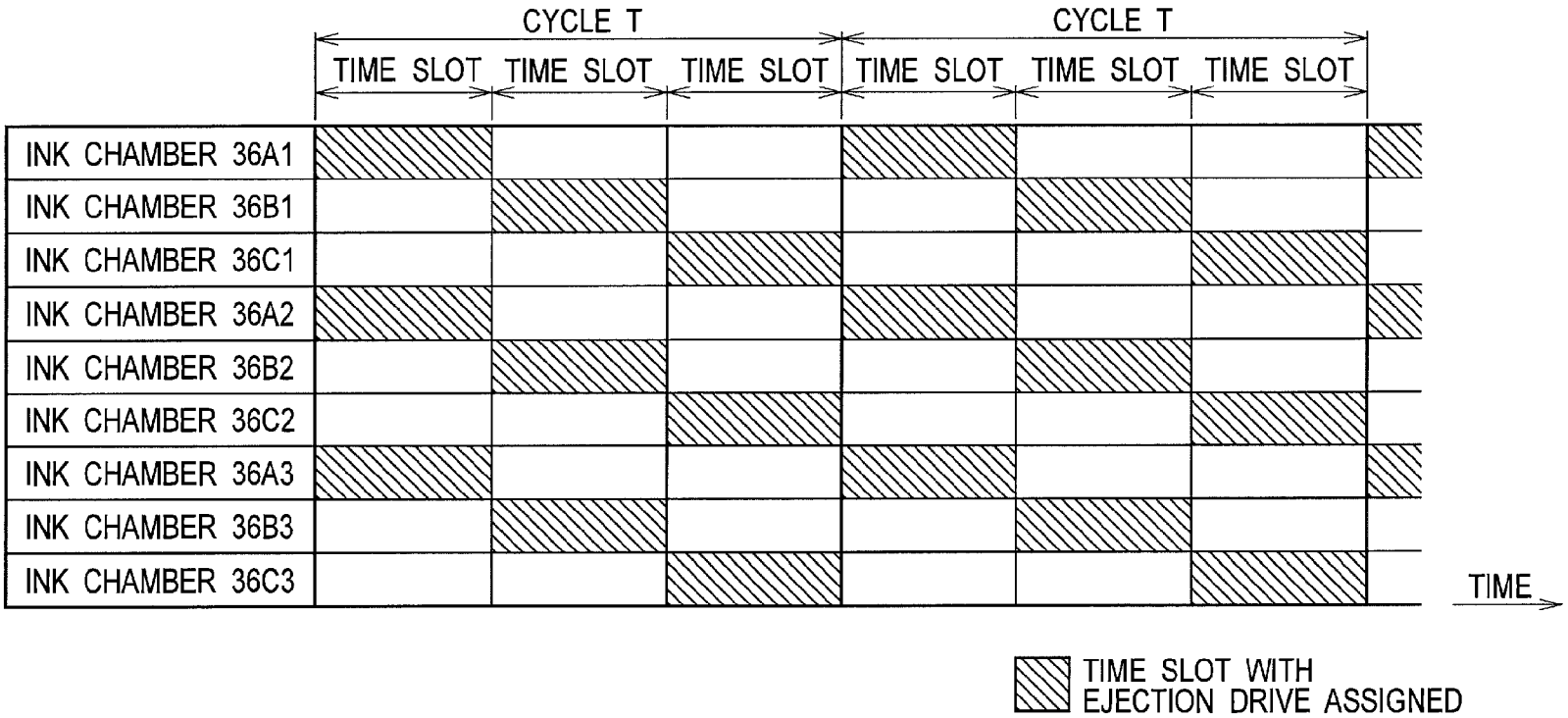
FIG. 12 is a timing diagram of the ejection drive of the ink chambers in time-division drive control.

FIG. 12 shows a timing diagram of the ejection drive of the ink chambers 36A1 to 36A3, 36B1 to 36B3, and 36C1 to 36C3 of FIG. 11. As shown in FIG. 12, one cycle T includes three time slots. In FIG. 12, a diagonally-hatched time slot is a period of time with ejection drive assigned in the corresponding ink chamber. In one cycle T, the ink chambers 36A1 to 36A3 of group A are driven for ejection in a first time slot, the ink chambers 36B1 to 36B3 of group B are driven for ejection in a next time slot, and the ink chambers 36C1 to 36C3 of group C are driven for ejection in a further next time slot. A single line of an image is printed per cycle T.

In each of the ink chambers 36, a number of ejection drives which is determined according to the drop number for each pixel based on image data are performed in each cycle T (in each time slot with ejection drive assigned). A maximum number (e.g., five drops) of drops to be ejected in one time slot is set in advance, and ink is ejected within the maximum drop number in a time slot with ejection drive assigned. There are cases where ejection drive is not performed (drop number is 0) in a time slot with ejection drive assigned.

Next, the normal waveform will be described.

Figure 13A:
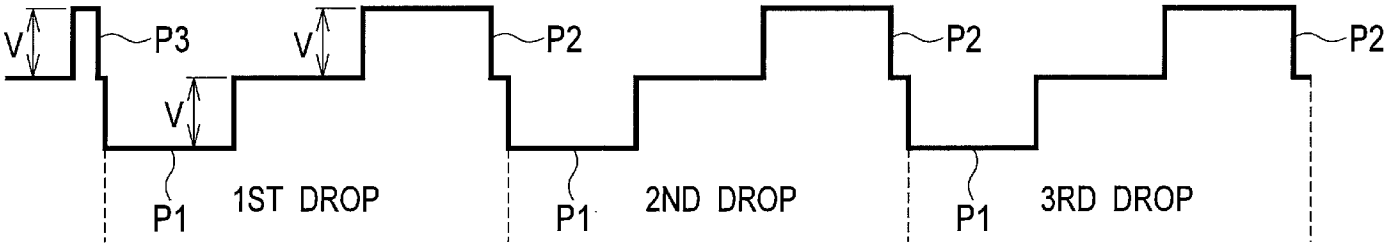
FIG. 13A is a diagram showing one example of a normal waveform.

FIG. 13A is a diagram showing one example of the normal waveform. As shown in FIG. 13A, the normal waveform includes a preliminary pulse P3 applied to the electrodes 41 prior to the application of the expanding pulse P1 for a first drop and subsequent waveforms shown in FIG. 8, the number of which is equal to the drop number. FIG. 13A is the normal waveform for the case where the drop number is three.

The preliminary pulse P3 is intended to apply a positive voltage (V) having the same magnitude as the contracting pulse P2 to the electrodes 41. The pulse length (applying time) of the preliminary pulse P3 is shorter than those of the expanding pulse P1 and the contracting pulse P2.

The normal waveform is designed so that a predetermined ink ejection amount and ejection speed can be achieved in the case of solid printing. Specifically, the normal waveform is a waveform which provides a predetermined ink ejection amount (0 to maximum ink ejection amount) and speed in the case where each ink chamber 36 is driven for ejection in all time slots with ejection drive assigned.

The reason for the use of the preliminary pulse P3 will be described. In a second or later drop ejected with respect to a single pixel, residual vibration after the ejection of the previous drop causes pressure fluctuation in the ink chamber 36, and ink is ejected from a state in which the meniscus in the nozzle 42 is moving. Meanwhile, in the case of solid printing, at the time of ejection drive for the first drop, residual vibration caused by the ejection drive of the adjacent ink chamber 36 in the immediately preceding time slot remains in the ink chamber 36. However, the residual vibration is smaller than residual vibration remaining at the time of the ejection of a second or later drop. Accordingly, at the time of the ejection of the first drop, pressure fluctuation in the ink chamber 36 is smaller compared with that at the time of the ejection of a second or later drop. As a result, the ejection amount of ink becomes small, and the ejection speed becomes low.

Meanwhile, when the preliminary pulse P3 is applied to the electrode 41 prior to the expanding pulse P1 for the first drop, the partition walls 38 on the two opposite sides of the ink chamber 36 deform toward each other, and a positive voltage is generated in the ink chamber 36. After the application of the preliminary pulse P3 is finished, when the expanding pulse P1 is applied, the partition walls 38 on the two opposite sides of the ink chamber 36 deform away from each other, and a negative pressure is generated in the ink chamber 36, as described previously. At this time, in response to the positive voltage generated by the application of the preliminary pulse P3, a peak of the negative pressure in the ink chamber 36 increases compared with that in the case where the preliminary pulse P3 is not applied.

After that, when the application of the expanding pulse P1 is finished, the partition walls 38 on the two opposite sides of the ink chamber 36 return to neutral positions, ink in the ink chamber 36 is rapidly pressurized, and ink is ejected from the nozzle 42, as described previously. At this time, in response to an increase in the peak of the negative voltage in the ink chamber 36 caused by the application of the preliminary pulse P3, the degree of pressurization of ink in the ink chamber 36 becomes high compared with that in the case where the preliminary pulse P3 is not applied. As a result, the ejection amount and ejection speed of ink increase compared with those in the case where the preliminary pulse P3 is not applied.

As described above, in the normal waveform, a reduction in the ejection amount of the first drop and a decrease in the ejection speed are reduced by applying the preliminary pulse P3 prior to ejection drive for the first drop.

Next, the corrected waveform will be described.

The corrected waveform is a waveform which increases the ejection amount and ejection speed of ink compared with those of the normal waveform. The corrected waveform is used in order to reduce misaligned ink landing.

Figure 13B:
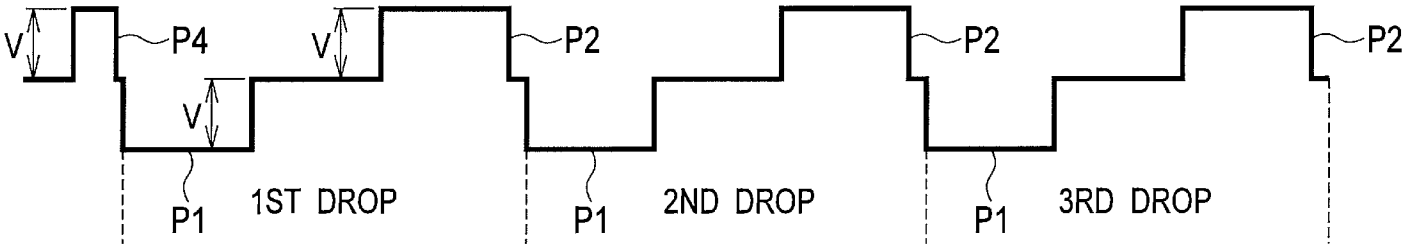
FIG. 13B is a diagram showing one example of a corrected waveform.

FIG. 13B is a diagram showing one example of the corrected waveform. As shown in FIG. 13B, the corrected waveform is a waveform obtained by replacing the preliminary pulse P3 in the normal waveform of FIG. 13A by a preliminary pulse P4 having a longer pulse length (applying time) than the preliminary pulse P3. In the preliminary pulse P4 of the corrected waveform, application start time is earlier than that of the preliminary pulse P3 of the normal waveform, and application end time is the same as that of the preliminary pulse P3 of the normal waveform.

In the corrected waveform, since the preliminary pulse P4 having a longer pulse length than the preliminary pulse P3 of the normal waveform is applied to the electrodes 41, the peak of the negative pressure in the ink chamber 36 when the expanding pulse P1 is applied to the electrodes 41 further increases. Thus, in the corrected waveform, the degree of pressurization in the ink chamber 36 when the application of the expanding pulse P1 is finished becomes higher than that in the case of the normal waveform. As a result, in the corrected waveform, the ejection amount and ejection speed of ink increase compared with those of the normal waveform.

Next, a printing operation of the inkjet printer 1 will be described.

When printing is started, the controller 4 controls the head gap adjuster 28 to adjust the head gap Hg according to the sheet type. The controller 4 determines the sheet type based on, for example, setting information contained in a print job inputted from the outside.

Subsequently, the controller 4 controls the conveying motor 16 to start the rotation of the conveyer belt 11. Moreover, the controller 4 starts the drive of the fan unit 17. When the sheet P is fed from an unillustrated sheet feed unit, the conveyer belt 11 in the conveyer 2 conveys the sheet P while holding the sheet P by suction.

The controller 4 causes the head driver 22 to drive the inkjet heads 31 based on image data, and causes an image to be printed on the sheet P which is being conveyed by the conveyer 2. The printed sheet P is discharged by an unillustrated sheet discharge unit.

At the time of the above-described printing, the controller 4 controls the head driver 22 based on the image data so that the head driver 22 may perform the ejection drive of the ink chamber 36 subjected to the ejection drive by time-division drive control. At this time, the controller 4 selects the normal waveform or the corrected waveform as a waveform of a drive signal for performing the ejection drive of the ink chamber 36 subjected to the ejection drive.

This waveform selection process for selecting the waveform of the drive signal will be described with reference to the flowchart of FIG. 14. A process represented by the flowchart of FIG. 14 is carried out for each of the ink chambers 36 to be driven for ejection.

Figure 14:
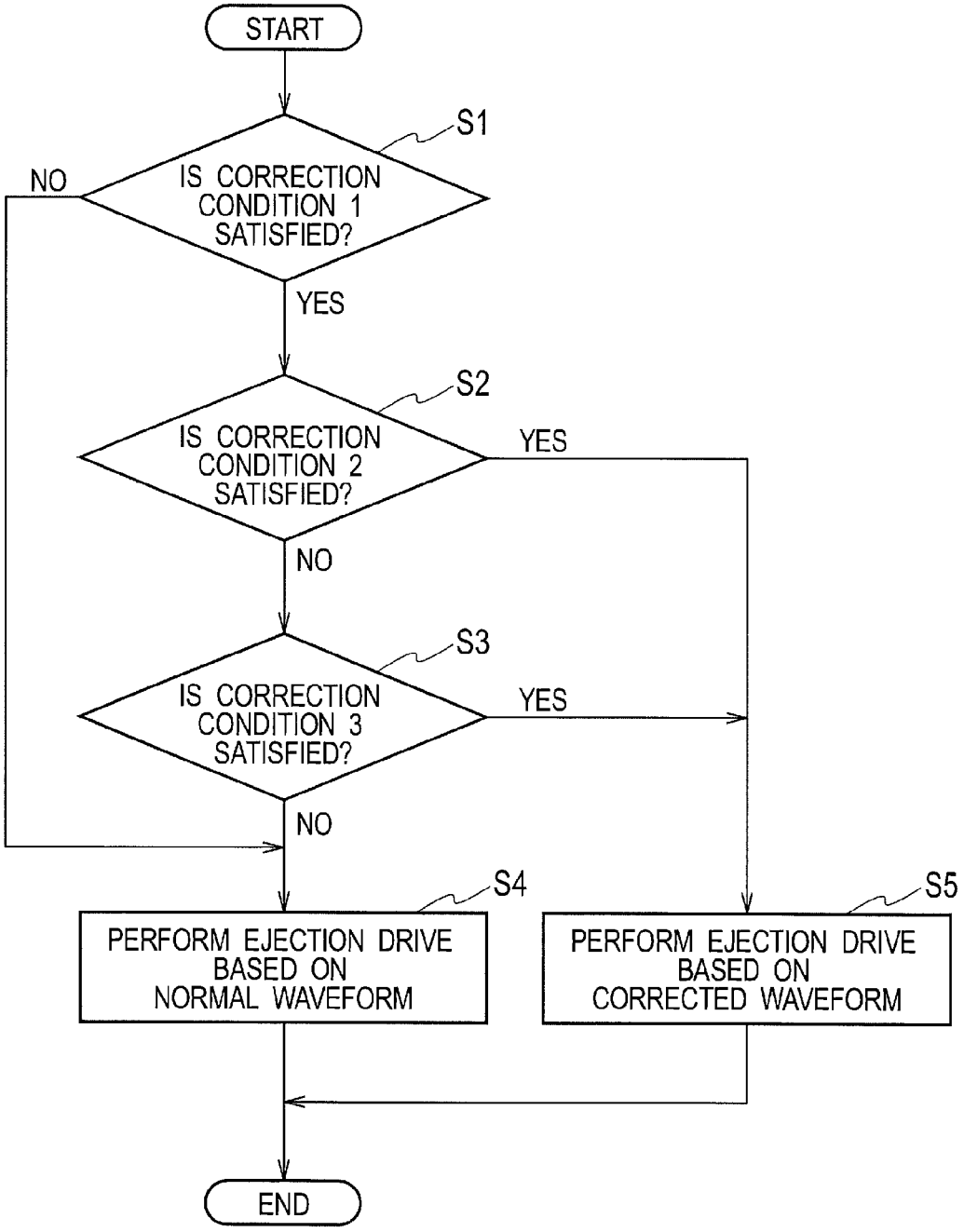
FIG. 14 is a flowchart of a waveform selection process.

In step S1 of FIG. 14, the controller 4 determines whether correction condition 1 is satisfied or not based on the image data at the time of the ejection drive of an ink chamber of interest subjected to the ejection drive.

Correction condition 1 is a condition in which the normal waveform causes decreases in the ejection amount and ejection speed of ink due to an ejection pattern according to the image data. Specifically, correction condition 1 is "that at the time of the ejection drive of the ink chamber 36 subjected to the ejection drive, at least one of ink chambers 36 which are arranged next to (i.e. adjacent on both sides of) the ink chamber 36 subjected to the ejection drive and which have possibilities of being driven for ejection in the immediately preceding time slot is not driven for ejection in the immediately preceding time slot, and that both the ink chambers 36 arranged next to the ink chamber 36 subjected to the ejection drive in the same group are also to be driven for ejection."

The former part of the above-described correction condition 1, "at least one of ink chambers 36 which are arranged next to (i.e. adjacent on both sides of) the ink chamber 36 subjected to the ejection drive and which have possibilities of being driven for ejection in the immediately preceding time slot is not driven for ejection in the immediately preceding time slot," means that the ejection amount and ejection speed of ink decrease because residual vibration caused by the ejection drive of ink chambers 36 arranged next to the ink chamber 36 subjected to the ejection drive does not exist or is smaller than that in the case of solid printing.

As described previously, the drive signal having the normal waveform provides a predetermined ejection amount and ejection speed of ink in the case of solid printing. In the case of solid printing, ink chambers arranged next to the ink chamber 36 subjected to the ejection drive are driven for ejection in the immediately preceding time slot. For example, in the example of FIG. 12, in the case of solid printing, the ink chambers 36A1 to 36A3 of group A are driven for ejection in the time slot immediately before the ink chambers 36B1 to 36B3 of group B are driven for ejection.

In the case where ink chambers arranged next to the ink chamber 36 subjected to the ejection drive have been driven for ejection in the immediately preceding time slot, residual vibration remains in the ink chamber 36 subjected to the ejection drive under the influence of the ejection drive. Accordingly, the drive signal having the normal waveform provides a predetermined ejection amount and ejection speed of ink in the case where the residual vibration exists. In the case where residual vibration does not exist, pressure fluctuation in the ink chamber 36 does not exist, and ejection is performed from a state in which the meniscus of the nozzle 42 is stationary. Accordingly, compared with the case where residual vibration exists, the ejection amount and ejection speed of ink decrease. Moreover, in the case where residual vibration exists but is smaller than that in the case of solid printing, also, the ejection amount and ejection speed of ink decrease.

Accordingly, in the case where the former part of the above-described correction condition 1 is satisfied, the ejection amount and ejection speed of ink decrease.

It should be noted that in the case where the number of groups in time-division drive control is three or more, there is only one ink chamber 36 which is arranged next to the ink chamber 36 subjected to the ejection drive and which has a possibility of being driven for ejection in the immediately preceding time slot. In the case where the number of groups is two, there are two ink chambers 36 which are arranged next to the ink chamber 36 subjected to the ejection drive and which have possibilities of being driven for ejection in the immediately preceding time slot. In this case where the number of groups is two, the former part of the above-described correction condition 1 is satisfied even if only one of the ink chambers 36 arranged next to the ink chamber 36 subjected to the ejection drive is not driven for ejection in the immediately preceding time slot.

The condition that "both the ink chambers 36 arranged next to the ink chamber 36 subjected to the ejection drive in the same group are also to be driven for ejection," which is the latter part of the above-described correction condition 1, means that there is no factor which increases the ejection amount and ejection speed of ink ejected from the ink chamber 36 subjected to the ejection drive.

In the case where the two ink chambers 36 arranged next to the ink chamber 36 subjected to the ejection drive in the same group are not driven for ejection, there is no movement which cancels out pressure fluctuation in the ink chamber 36 subjected to the ejection drive. Accordingly, the ejection amount and ejection speed of ink ejected from the ink chamber 36 subjected to the ejection drive increase compared with those in the case of solid printing. Even in the case where one of the two ink chambers 36 arranged next to the ink chamber 36 subjected to the ejection drive in the same group is not driven for ejection, the ejection amount and ejection speed of ink ejected from the ink chamber 36 subjected to the ejection drive increase. Meanwhile, in the case where both the ink chambers 36 arranged next to the ink chamber 36 subjected to the ejection drive in the same group are also to be driven for ejection, the situation is the same as solid printing, and the ejection amount and ejection speed of ink do not increase.

Accordingly, in the case where the above-described correction condition 1 is satisfied, the drive signal having the normal waveform decreases the ejection amount and ejection speed of ink ejected from the ink chamber 36 compared with a predetermined ejection amount and ejection speed of ink.

If it is determined in step S1 that correction condition 1 is satisfied (step S1: YES), the controller 4 determines whether the head-to-sheet distance Hp is larger than the threshold value Hth or not (i.e., whether correction condition 2 is satisfied or not) in step S2. Here, as described previously, the controller 4 stores a head-to-sheet distance Hp corresponding to each sheet type.

If it is determined that the head-to-sheet distance Hp is not more than the threshold value Hth (i.e., that correction condition 2 is not satisfied) (step S2: NO), the controller 4 determines whether the landing position of ink ejected by the ejection drive of the ink chamber of interest is located within the correction target region R or not (i.e., whether correction condition 3 is satisfied or not) based on the image data in step S3.

If it is determined that the landing position of ink ejected by the ejection drive of the ink chamber of interest is located outside the correction target region R (i.e., that correction condition 3 is not satisfied) (step S3: NO), the controller 4 controls the head driver 22 in step S4 so that the head driver 22, may perform the ejection drive of the ink chamber of interest based on the drive signal having the normal waveform.

If it is determined in step S1 that correction condition 1 is not satisfied (step S1: NO), the controller 4 goes to step S4.

If it is determined in step S2 that the head-to-sheet distance Hp is larger than the threshold value Hth (i.e., that correction condition 2 is satisfied) (step S2: YES), and if it is determined in step S3 that the landing position of ink ejected by the ejection drive of the ink chamber of interest is located within the correction target region R (i.e., that correction condition 3 is satisfied) (step S3: YES), the controller 4 controls the head driver 22 in step S5 so that the head driver 22 may perform the ejection drive of the ink chamber of interest based on the drive signal having the corrected waveform.

As described above, in the inkjet printer 1, at the time of the ejection drive of the ink chamber 36 subjected to the ejection drive, if correction conditions (correction conditions 1 to 3) are satisfied in the above-described patterns, the controller 4 performs the ejection drive of the ink chamber 36 subjected to the ejection drive using the drive signal having the corrected waveform which increases the ejection amount and ejection speed of ink compared with those of the normal waveform. Specifically, if the head-to-sheet distance Hp is not more than the threshold value Hth (i.e., if correction condition 2 is not satisfied), and if the landing position of ink ejected by the ejection drive of the ink chamber 36 subjected to the ejection drive is located outside the correction target region R (i.e., if correction condition 3 is not satisfied), the controller 4 performs the ejection drive of the ink chamber 36 subjected to the ejection drive based on the drive signal having the normal waveform even if correction condition 1 is satisfied.

If the head-to-sheet distance Hp is not more than the threshold value Hth (i.e., if correction condition 2 is not satisfied), and if the landing position of ink ejected by the ejection drive of the ink chamber 36 subjected to the ejection drive is located within the correction target region R (i.e., if correction condition 3 is satisfied), and if correction condition 1 is satisfied, the controller 4 performs the ejection drive of the ink chamber 36 subjected to the ejection drive based on the drive signal having the corrected waveform. If the head-to-sheet, distance Hp is larger than the threshold value Hth (i.e., if correction condition 2 is satisfied), and if correction condition 1 is satisfied, the controller 4 performs the ejection drive of the ink chamber 36 subjected to the ejection drive based on the drive signal having the corrected waveform regardless of the landing position of ink ejected by the ejection drive of the ink chamber 36 subjected to the ejection drive (even if the landing position is located outside the correction target region R) (i.e., regardless of whether correction condition 3 is satisfied or not).

Thus, in the inkjet printer 1 including the shear-mode inkjet head 31, the head gap adjuster 28 configured to adjust the head-to-sheet distance Hp, and the air-suction-type conveyer 2, misaligned ink landing and print quality degradation can be reduced by appropriate ink ejection drive according to the degree of influence of an ejection pattern according to image data, the head-to-sheet distance Hp, and air suction on misaligned ink landing.

It should be noted that a temperature sensor may be provided in the inkjet head 31 so that the controller 4 may adjust the corrected waveform according to the temperature of ink detected by the temperature sensor. As the temperature of ink decreases, the viscosity of ink increases, and ink becomes less easily ejected from the inkjet head 31. Accordingly, for example, the preliminary pulse in the corrected waveform may be widened as the temperature of ink decreases so that ink may be easily ejected. Thus, misaligned ink landing and print quality degradation can be further reduced.

Moreover, in the waveform selection process, a determination as to whether the landing position of ink ejected by the ejection drive of the ink chamber 36 subjected to the ejection drive is located outside the correction target region R or not may be omitted. In this case, if correction condition 1 is satisfied, the corrected waveform is used if the head-to-sheet distance Hp is larger than the threshold value Hth (i.e., if correction condition 2 is satisfied), and the normal waveform is used if the head-to-sheet distance Hp is not more than the threshold value Hth (i.e., if correction condition 2 is not satisfied). In this method, misaligned ink landing and print quality degradation can also be reduced by appropriate ink ejection drive according to the degree of influence of the head-to-sheet distance Hp on misaligned ink landing.

Moreover, in the waveform selection process, a determination as to whether the head-to-sheet distance Hp is not more than the threshold value Hth or not (i.e., whether correction condition 2 is satisfied or not) may be omitted. In this case, if correction condition 1 is satisfied, the corrected waveform is used if the landing position of ink ejected by the ejection drive of the ink chamber 36 subjected to the ejection drive is located within the correction target region R (i.e., if correction condition 3 is satisfied), and the normal waveform is used if the landing position of ink is located outside the correction target region R (i.e., if correction condition 3 is not satisfied). In this method, misaligned ink landing and print quality degradation can also be reduced by appropriate ink ejection drive according to the degree of influence of air suction on misaligned ink landing.

Moreover, determinations as to correction conditions 2 and 3 may be omitted. In this case, the corrected waveform is used if only correction condition 1 is satisfied, and the normal waveform is used if correction condition 1 is not satisfied. In this method, misaligned ink landing and print quality degradation can also be reduced.

In the above-described embodiment, a waveform in which the pulse length of the preliminary pulse is longer compared with that of the normal waveform is used as the corrected waveform, but the present invention is not limited to this. Any waveform which increases the ejection amount and ejection speed of ink compared with those of the normal waveform may be used as the corrected waveform. For example, a waveform in which the voltages of the expanding pulse P1 and the contracting pulse P2 for a first drop are increased may be used.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head configured to eject ink onto a sheet being conveyed, the inkjet head comprising a plurality of ink chambers isolated from each other by partition walls and arranged next to one another in a row, a plurality of nozzles communicating with the respective ink chambers and configured to eject the ink in the ink chambers, and a plurality of variable portions configured to selectively deform the partition walls in response to one of a drive signal having a normal waveform and a drive signal having a corrected waveform which increases an ejection amount and an ejection speed of the ink compared with an ejection amount and an ejection speed of the normal waveform, and to cause the ink to be ejected from the plurality of nozzles by changes in pressures in the ink chambers due to deformations of the partition walls;

a driver configured to perform an ejection drive of each of the ink chambers by selectively supplying the drive signal having the normal waveform and the drive signal having the corrected waveform to the plurality of variable portions;

a controller configured to divide the plurality of ink chambers into n+1 (n=1, 2, . . . ) groups each formed by taking ink chambers while skipping n ink chambers from among the plurality of ink chambers, and to drive the driver to perform the ejection drive of the ink chambers subjected to the ejection drive in units of the groups, and complete the ejection drive of the ink chambers subjected to the ejection drive in all the groups within one cycle including n+1 time slots corresponding to the respective groups; and an adjuster configured to adjust a distance between an ejection surface of the inkjet head and the sheet to be printed with the ink ejected from the nozzles, the ejection surface including openings of the nozzles, wherein, upon driving the driver to perform the ejection drive of each of the ink chambers subjected to the ejection drive, the controller is configured to drive the driver to supply the drive signal having the normal waveform when a correction condition is not satisfied, and drive the driver to supply the drive signal having the corrected waveform when the correction condition is satisfied, wherein the correction condition comprises that at least one of the ink chambers arranged next to the ink chamber subjected to the ejection drive is not subjected to the ejection drive in an immediately preceding time slot, that both the ink chambers arranged next to the ink chamber subjected to the ejection drive in a same group are subjected to the ejection drive, and that the distance between the ejection surface and the sheet is larger than a threshold value.

2. The inkjet printer according to claim 1, wherein the controller is configured to adjust the corrected waveform according to a temperature of the ink.

3. An inkjet printer comprising:

an inkjet head configured to eject ink onto a sheet being conveyed, the inkjet head comprising a plurality of ink chambers isolated from each other by partition walls and arranged next to one another in a row, a plurality of nozzles communicating with the respective ink chambers and configured to eject the ink in the ink chambers, and a plurality of variable portions configured to selectively deform the partition walls in response to one of a drive signal having a normal waveform and a drive signal having a corrected waveform which increases an ejection amount and an ejection speed of the ink compared with an ejection amount and an ejection speed of the normal waveform, and to cause the ink to be ejected from the plurality of nozzles by changes in pressures in the ink chambers due to deformations of the partition walls;

a driver configured to perform an ejection drive of each of the ink chambers by selectively supplying the drive signal having the normal waveform and the drive signal having the corrected waveform to the plurality of variable portions;

a sheet conveyer configured to convey the sheet being printed with the ink ejected from the nozzles while holding the sheet by air suction; and a controller configured to divide the plurality of ink chambers into n+1 (n=1, 2, . . . ) groups each formed by taking ink chambers while skipping n ink chambers from among the plurality of ink chambers, and to drive the driver to perform the ejection drive of the ink chambers subjected to the ejection drive in units of the groups, and complete the ejection drive of the ink chambers subjected to the ejection drive in all the groups within one cycle including n+1 time slots corresponding to the respective groups, wherein, upon driving the driver to perform the ejection drive of each of the ink chambers subjected to the ejection drive, the controller is configured to drive the driver to supply the drive signal having the normal waveform when a correction condition is not satisfied, and drive the driver to supply the drive signal having the corrected waveform when the correction condition is satisfied, and wherein the correction condition comprises that at least one of the ink chambers arranged next to the ink chamber subjected to the ejection drive is not subjected to the ejection drive in an immediately preceding time slot, that both the ink chambers arranged next to the ink chamber subjected to the ejection drive in a same group are subjected to the ejection drive, and that a landing position of the ink ejected by the ejection drive of the ink chamber subjected to the ejection drive is located within a correction target region in an outer peripheral portion of the sheet.

4. The inkjet printer according to claim 3, wherein the controller is configured to adjust the corrected waveform according to a temperature of the ink.

5. An inkjet printer comprising:

an inkjet head configured to eject ink onto a sheet being conveyed, the inkjet head comprising a plurality of ink chambers isolated from each other by partition walls and arranged next to one another in a row, a plurality of nozzles communicating with the respective ink chambers and configured to eject the ink in the ink chambers, and a plurality of variable portions configured to selectively deform the partition walls in response to one of a drive signal having a normal waveform and a drive signal having a corrected waveform which increases an ejection amount and an ejection speed of the ink compared with an ejection amount and an ejection speed of the normal waveform, and to cause the ink to be ejected from the plurality of nozzles by changes in pressures in the ink chambers due to deformations of the partition walls;

a driver configured to perform an ejection drive of each of the ink chambers by selectively supplying the drive signal having the normal waveform and the drive signal having the corrected waveform to the plurality of variable portions;

a sheet conveyer configured to convey the sheet being printed with the ink ejected from the nozzles while holding the sheet by air suction;

an adjuster configured to adjust a distance between an ejection surface of the inkjet head and the sheet being conveyed by the sheet conveyer, the ejection surface including openings of the nozzles; and a controller configured to divide the plurality of ink chambers into n+1 (n=1, 2, . . . ) groups each formed by taking ink chambers while skipping n ink chambers from among the plurality of ink chambers, and to drive the driver to perform the ejection drive of the ink chambers subjected to the ejection drive in units of the groups, and complete the ejection drive of the ink chambers subjected to the ejection drive in all the groups within one cycle including n+1 time slots corresponding to the respective groups, wherein, upon driving the driver to perform the ejection drive of each of the ink chambers subjected to the ejection drive, the controller is configured to drive the driver to supply the drive signal having the normal waveform when a correction condition is not satisfied, and drive the driver to supply the drive signal having the corrected waveform when the correction condition is satisfied, and wherein the correction condition comprises that at least one of the ink chambers arranged next to the ink chamber subjected to the ejection drive is not subjected to the ejection drive in an immediately preceding time slot, that both the ink chambers arranged next to the ink chamber subjected to the ejection drive in a same group are subjected to the ejection drive, and that the distance between the ejection surface and the sheet is larger than a threshold value, or that a landing position of the ink ejected by the ejection drive of the ink chamber subjected to the ejection drive is located within a correction target region in an outer peripheral portion of the sheet.

6. The inkjet printer according to claim 5, wherein the controller is configured to adjust the corrected waveform according to a temperature of the ink.

* * * * *